US011332802B2

(12) United States Patent
Yu et al.

(10) Patent No.: US 11,332,802 B2
(45) Date of Patent: May 17, 2022

(54) HIGH-HARDNESS WEAR-RESISTANT STEEL AND METHOD FOR MANUFACTURING SAME

(71) Applicant: POSCO, Pohang-si (KR)

(72) Inventors: Seng-Ho Yu, Pohang-si (KR); Mun-Young Jung, Seoul (KR); Young-Jin Jung, Pohang-si (KR)

(73) Assignee: POSCO, Pohang-si (KR)

( * ) Notice: Subject to any disclaimer, the term of this patent is extended or adjusted under 35 U.S.C. 154(b) by 289 days.

(21) Appl. No.: 16/471,313

(22) PCT Filed: Dec. 4, 2017

(86) PCT No.: PCT/KR2017/014097
§ 371 (c)(1),
(2) Date: Jun. 19, 2019

(87) PCT Pub. No.: WO2018/117482
PCT Pub. Date: Jun. 28, 2018

(65) Prior Publication Data

US 2019/0382866 A1 Dec. 19, 2019

(30) Foreign Application Priority Data

Dec. 22, 2016 (KR) ..... 10-2016-0177142

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |

(52) U.S. Cl.
CPC ..... *C21D 9/46* (2013.01); *C21D 6/004* (2013.01); *C21D 6/005* (2013.01); *C21D 6/007* (2013.01); *C21D 6/008* (2013.01); *C21D 8/0205* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/002* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 2009/0107588 | A1 | 4/2009 | Allain et al. |
| 2014/0003990 | A1 | 1/2014 | Kou |
| 2015/0225822 | A1 | 8/2015 | Miura et al. |
| 2016/0002759 | A1 | 1/2016 | Li et al. |
| 2016/0076118 | A1 | 3/2016 | Nagao et al. |
| 2019/0390293 | A1* | 12/2019 | Yu ..... C22C 38/44 |

FOREIGN PATENT DOCUMENTS

| | | | |
|---|---|---|---|
| CN | 101270439 | A | 9/2008 |
| CN | 101437975 | A | 5/2009 |
| CN | 101586217 | A | 11/2009 |
| CN | 101600812 | A | 12/2009 |
| CN | 103146997 | A | 6/2013 |
| CN | 103194684 | A | 7/2013 |
| CN | 104662193 | A | 5/2015 |
| CN | 105008570 | A | 10/2015 |
| EP | 2128288 | A1 | 12/2009 |
| EP | 2592168 | A1 | 5/2013 |
| EP | 2942414 | A1 | 11/2015 |
| JP | S61-166954 | A | 7/1986 |
| JP | S63-024045 | A | 2/1988 |
| JP | H02-179842 | A | 7/1990 |
| JP | H08-041535 | A | 2/1996 |
| JP | 2005-240135 | A | 9/2005 |
| JP | 2005-256169 | A | 9/2005 |
| JP | 2006-104489 | A | 4/2006 |
| JP | 2007-119850 | A | 5/2007 |
| JP | 2008-255451 | A | 10/2008 |
| JP | 2014-194042 | A | 10/2014 |
| JP | 2014-227583 | A | 12/2014 |
| JP | 2016-509630 | A | 3/2016 |
| JP | 2016-079459 | A | 5/2016 |

(Continued)

OTHER PUBLICATIONS

English machine translation of JP 2007-119850 A of Murota published May 2007 (Year: 2007).*
Extended European Search Report dated Oct. 9, 2019 issued in European Patent Application No. 17884425.4.
Irvin R. Kramer, et al., "Effect of Sixteen Alloying Elements on Hardenability of Steel," American Institute of Mining and Metallurgical Engineers, Technical Publication No. 1636, Sep. 1943, pp. 1-11.

(Continued)

*Primary Examiner* — Jophy S. Koshy
(74) *Attorney, Agent, or Firm* — Morgan, Lewis & Bockius LLP

(57) ABSTRACT

One aspect of the present invention aims to provide high-hardness wear-resistant steel having excellent wear resistance to a thickness of 40t (mm) as well as high strength and impact toughness, and a method for manufacturing same.

5 Claims, 1 Drawing Sheet

(56) References Cited

FOREIGN PATENT DOCUMENTS

| | | | |
|---|---|---|---|
| KR | 10-1999-0042043 | A | 6/1999 |
| KR | 10-2003-0054423 | A | 7/2003 |
| KR | 10-2008-0106337 | A | 12/2008 |
| KR | 10-2011-0075613 | A | 7/2011 |
| KR | 10-2012-0071615 | A | 7/2012 |
| KR | 10-2013-0046967 | A | 5/2013 |
| KR | 10-2014-0002518 | A | 1/2014 |
| KR | 10-2015-0036798 | A | 4/2015 |

OTHER PUBLICATIONS

Japanese Office Action dated Jul. 14, 2020 issued in Japanese Patent Application No. 2019-534254.

Chinese Office Action dated Aug. 4, 2020 issued in Chinese Patent Application No. 201780078976.2 (with English translation).

Chinese Office Action dated Mar. 12, 2021 issued in Chinese Patent Application No. 201780078976.2 (with English translation).

* cited by examiner

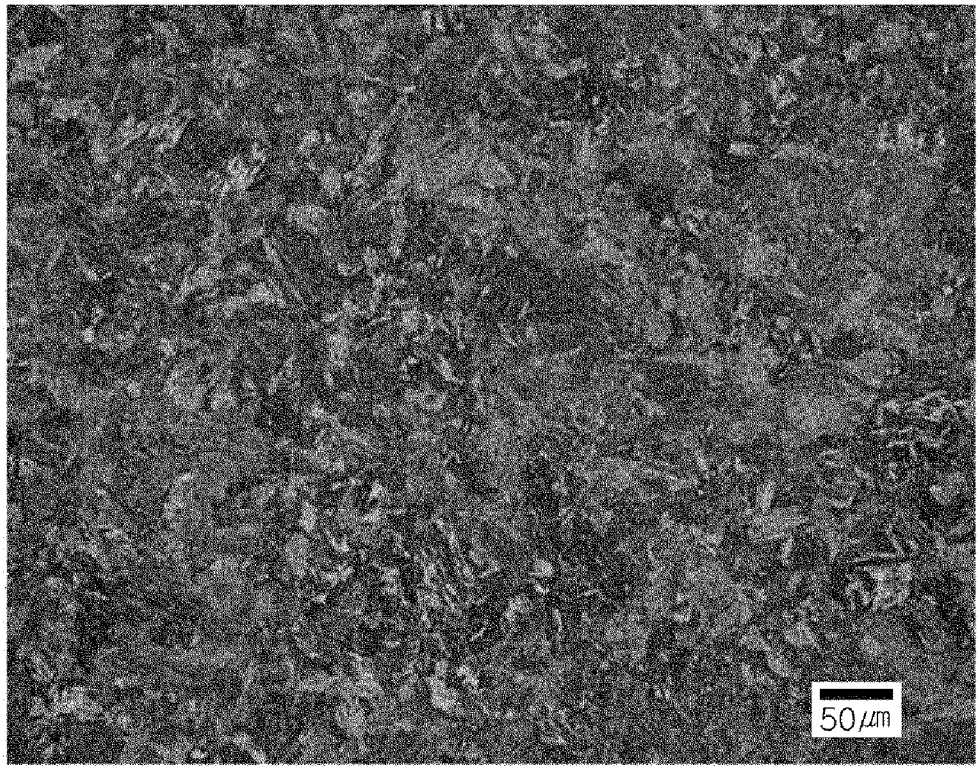
50 μm

HIGH-HARDNESS WEAR-RESISTANT STEEL AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/014097, filed on Dec. 4, 2017, which in turn claims the benefit of Korean Patent Application No. 10-2016-0177142, filed Dec. 22, 2016, the entire disclosures of which applications are incorporated by reference herein.

TECHNICAL FIELD

The present disclosure relates to wear-resistant steel used in construction machinery, and more particularly, to high-hardness wear-resistant steel and a manufacturing method thereof.

BACKGROUND ART

In the case of construction machinery, industrial machinery, and the like, used in many industries such as construction, civil engineering, the mining industry, the cement industry, and the like, abrasion due to friction may occur severely during operations, and thus it is necessary to apply a material having the characteristics of wear resistance.

In general, there is a correlation between the wear resistance and hardness of steel, so it is necessary to increase hardness in steel which may be worn down. In order to secure more stable wear resistance, it is necessary to have uniform hardness through a plate interior (around t/2, t=thickness) in a thickness direction from a surface of a steel plate (that is, to have hardness at the same level in a surface and an interior of a steel plate).

According to the related art, in order to obtain high hardness in a steel plate having a thickness above a certain level, a method of quenching after reheating at a temperature of Ac3 or more after rolling is widely used.

As an example, in Patent Documents 1 and 2, disclosed is a method of increasing the surface hardness by increasing the content of C and adding a large amount of elements for improving hardenability such as Cr and Mo.

However, in order to manufacture a steel plate having a certain thickness, it is necessary to add a larger amount of hardenability elements for securing hardenability in the center region of a steel plate. In this case, as large amounts of C and hardenability alloys are added, manufacturing costs are increased and weldability and low temperature toughness are deteriorated.

Therefore, in the situation in which it is inevitable to add a hardenability alloy for securing hardenability, a method for having excellent wear resistance by securing high hardness, as well as securing high strength and impact toughness has been necessary.

(Patent Document 1) Japanese Patent Laid-Open Publication No. 1996-041535

(Patent Document 2) Japanese Patent Laid-Open Publication No. 1986-166954

DISCLOSURE

Technical Problem

An aspect of the present disclosure may provide high-hardness wear-resistant steel having excellent wear resistance to a thickness of 40 mm or less as well as high strength and impact toughness, and a method for manufacturing the same.

Technical Solution

According to an aspect of the present disclosure, high-hardness wear-resistant steel includes 0.08 wt. % to 0.16 wt. % of carbon (C), 0.1 wt. % to 0.7 wt. % of silicon (Si), 0.8 wt. % to 1.6 wt. % of manganese (Mn), 0.05 wt. % or less of phosphorous (P) (excluding 0 wt. %), 0.02 wt. % or less of sulfur (S) (excluding 0 wt. %), 0.07 wt. % or less of aluminum (Al) (excluding 0 wt. %), 0.1 wt. % to 1.0 wt. % of chromium (Cr), 0.01 wt. % to 0.1 wt. % of nickel (Ni), 0.01 wt. % to 0.2 wt. % of molybdenum (Mo), 50 ppm or less of boron (B) (excluding 0 ppm), and 0.04 wt. % or less of cobalt (Co) (excluding 0 wt. %), further includes one or more among 0.1 wt. % or less of copper (Cu) (excluding 0 wt. %), 0.02 wt. % or less of titanium (Ti) (excluding 0 wt. %), 0.05 wt. % or less of niobium (Nb) (excluding 0 wt. %), 0.02 wt. % or less of vanadium (V) (excluding 0 wt. %), and 2 ppm to 100 ppm of calcium (Ca), includes the balance of iron (Fe) and other inevitable impurities, and satisfies Relation 1, and a microstructure includes martensite in an area fraction of 97% or more and bainite in an area fraction of 3% or less.

$$360 \leq (869 \times [C]) + 295 \leq 440 \quad \text{[Relation 1]}$$

Here, [C] means weight %.

According to another aspect of the present disclosure, a method for manufacturing high-hardness wear-resistant steel includes: preparing a steel slab satisfying the alloy composition described above and Relation 1; reheating the steel slab to a temperature in a range of 1050° C. to 1250° C.; rough rolling the reheated steel slab to a temperature in a range of 950° C. to 1050° C.; manufacturing a hot-rolled steel plate by finish rolling at a temperature in a range of 750° C. to 950° C., after the rough rolling; reheating heat treatment in a furnace time of 20 minutes or more to a temperature in a range of 850° C. to 950° C., after the hot-rolled steel plate is air-cooled to room temperature; and quenching the hot-rolled steel plate to 100° C. or less at a cooling rate satisfying Relation 2, after the reheating heat treating.

$$CR \geq 0.2/[C] \quad \text{[Relation 2]}$$

Here, CR is a cooling rate (° C./s) during quenching after the reheating heat treating, and [C] means weight %.

Advantageous Effects

According to an exemplary embodiment in the present disclosure, wear-resistant steel having high hardness and high strength is provided to a steel material having a thickness of 4 mm to 40 mm.

DESCRIPTION OF DRAWINGS

FIG. 1 is a measurement image of a microstructure of Inventive Example 8, according to an embodiment.

BEST MODE FOR INVENTION

The inventors of the present disclosure have conducted intensive research into materials which could be suitably applied to construction machinery, and the like. In detail, in order to provide a steel material having high hardness for securing wear resistance, essentially required material properties, as well as high strength and high toughness, the content of hardenability elements, as an alloy composition, is optimized, while manufacturing conditions are optimized. Therefore, it is confirmed that wear-resistant steel having a microstructure, which is advantageous for securing the material properties described above, is provided, and the present disclosure has been accomplished.

Hereinafter, the present disclosure will be explained in detail.

High-hardness wear-resistant steel according to an aspect of the present disclosure preferably includes, by weight %, 0.08% to 0.16% of carbon (C), 0.1% to 0.7% of silicon (Si), 0.8% to 1.6% of manganese (Mn), 0.05% or less of phosphorous (P) (excluding 0%), 0.02% or less of sulfur (S) (excluding 0%), 0.07% or less of aluminum (Al) (excluding 0%), 0.1% to 1.0% of chromium (Cr), 0.01% to 0.1% of nickel (Ni), 0.01% to 0.2% of molybdenum (Mo), 50 ppm or less of boron (B) (excluding 0 ppm), and 0.04% or less of cobalt (Co) (excluding 0%).

Hereinafter, the reason for the control of the alloy composition of the high-hardness wear-resistant steel provided in the present disclosure as described above will be described in detail. In this case, unless otherwise specified, the content of each component means weight %.

Carbon (C): 0.08% to 0.16%

Carbon (C) is effective for increasing strength and hardness in steel with a martensitic structure and is an element effective for improving hardenability.

In order to sufficiently secure the above-described effect, it is preferable to add C in an amount of 0.08% or more. However, if the content of C exceeds 0.16%, weldability and toughness may be deteriorated.

Therefore, in the present disclosure, the content of C is preferably controlled to 0.08% to 0.16%, and more preferably contained in an amount of 0.10% to 0.14%.

Silicon (Si): 0.1% to 0.7%

Silicon (Si) is an element effective for improving deoxidation and strength by solid solution strengthening.

In order to obtain the effect effectively, it is preferable to add Si in an amount of 0.1% or more. However, if the content of Si exceeds 0.7%, weldability may be deteriorated, which is not preferable.

Therefore, in the present disclosure, the content of Si is preferably controlled to 0.1% to 0.7%. More preferably, Si may be included in an amount of 0.2% to 0.5%.

Manganese (Mn): 0.8% to 1.6%

Manganese (Mn) is an element for suppressing ferrite formation, and lowering the Ar3 temperature to effectively increase the hardenability, thereby improving the strength and toughness of the steel.

In the present disclosure, in order to secure hardness of a steel material having a thickness of 40 mm or less, it is preferable add Mn in an amount of 0.8% or more. However, if the content of Mn exceeds 1.6%, a segregation region such as MnS is promoted in the center region, which not only increases the probability of cracking during a cutting operation but also deteriorates the weldability.

Therefore, in the present disclosure, the content of Mn is preferably controlled to 0.8% to 1.6%.

Phosphorus (P): 0.05% or less (excluding 0%)

Phosphorus (P) is an element, inevitably contained in the steel, while inhibiting the toughness of the steel. Therefore, it is preferable that the content of P is controlled to be as low as possible to 0.05% or less. However, 0% is excluded in consideration of the levels inevitably added.

Sulfur (S): 0.02% or less (excluding 0%)

Sulfur (S) is an element for inhibiting toughness of steel by forming MnS inclusions in the steel. Therefore, the content of S is controlled as low as possible to preferably 0.02% or less, and more preferably 0.01% or less. However, 0% is excluded in consideration of the levels inevitably added.

Aluminum (Al): 0.07% or less (excluding 0%)

Aluminum (Al), as a deoxidizing agent of steel, is an element effective in lowering the content of oxygen in molten steel. If the content of Al exceeds 0.07%, cleanliness of steel may be deteriorated, which is not preferable.

Therefore, in the present disclosure, it is preferable to control the content of Al to 0.07% or less. In addition, 0% is excluded in consideration of load during a steelmaking process, increase in manufacturing costs, and the like.

Chromium (Cr): 0.1% to 1.0%

Chromium (Cr) is an element, increasing strength by increasing hardenability of steel, and advantageous in securing hardness.

For the above-described effect, Cr is preferably added in an amount of 0.1% or more. However, if the content of Cr exceeds 1.0%, weldability may be low, which may increase the manufacturing costs.

Therefore, in the present disclosure, the content of Cr is preferably controlled to 0.1% to 1.0%.

Nickel (Ni): 0.01% to 0.1%

Nickel (Ni) is an element effective for increasing toughness as well as strength of steel by increasing hardenability of steel together with Cr.

For the above-described effect, Ni is preferably added in an amount of 0.01% or more. However, if the content of Ni exceeds 0.1%, Ni, a relatively expensive element, may increase the manufacturing costs.

Therefore, in the present disclosure, the content of Ni is preferably controlled to 0.01% to 0.1%.

Molybdenum (Mo): 0.01% to 0.2%

Molybdenum (Mo) is an element effective for increasing hardenability of steel, and particularly, for improving hardness of steel.

In order to sufficiently obtain the effect described above, Mo is preferably added in an amount of 0.01% or more. However, if the content of Mo, a relatively expensive element, exceeds 0.2%, so that not only the manufacturing costs increase but also the weldability becomes low.

Therefore, in the present disclosure, the content of Mo is preferably controlled to 0.01% to 0.2%.

Boron (B): 50 ppm or Less (Excluding 0 ppm)

Boron (B) is an element effective for improving strength by effectively increasing hardenability of steel even when B is added in a small amount.

However, if the content of B is excessive, toughness and weldability of steel may be deteriorated. Therefore, the content of B is preferably controlled to 50 ppm or less, and 0 ppm is excluded.

Cobalt (Co): 0.04% or less (excluding 0%)

Cobalt (Co) is an element advantageous in securing hardness as well as strength of steel, by increasing the hardenability of the steel.

However, if the content of Co exceeds 0.04%, hardenability of steel may be lowered. In addition, Co, a relatively expensive element, may increase manufacturing costs.

Therefore, in the present disclosure, Co is preferably added in an amount of 0.04% or less, and 0% is excluded. Moreover, Co is added more preferably in an amount of 0.005% to 0.035%, and even more preferably in an amount of 0.01% to 0.03%.

The wear-resistant steel of the present disclosure may further include elements advantageous in securing material properties desired in the present disclosure, in addition to the alloy composition described above.

In detail, the wear-resistant steel may further include one or more selected from the group consisting of 0.1% or less of copper (Cu) (excluding 0%), 0.02% or less of titanium (Ti) (excluding 0%), 0.05% or less of niobium (Nb) (excluding 0%), 0.02% or less of vanadium (V) (excluding 0%), and 2 ppm to 100 ppm of calcium (Ca).

Copper (Cu): 0.1% or less (excluding 0%) Copper (Cu) is an element for improving hardenability of steel, and improving strength and hardness of steel by solid solution strengthening.

If the content of Cu exceeds 0.1%, a surface defect may be generated, and hot workability may be deteriorated. Therefore, when Cu is added, Cu is preferably added in an amount of 0.1% or less.

Titanium (Ti): 0.02% or Less (Excluding 0%)

Titanium (Ti) is an element for significantly increasing the effect of B, an element effective for improving the hardenability of steel. In detail, Ti is combined with nitrogen (N) in the steel to form. TiN precipitates, thereby suppressing the formation of BN. Therefore, the solid solution B is increased, and thus the improvement of the hardenability may be significantly increased.

However, if the content of Ti exceeds 0.02%, coarse TiN precipitates are formed, so that the toughness of steel may be low.

Therefore, in the present disclosure, when Ti is added, Ti is preferably added in an amount of 0.02% or less.

Niobium (Nb): 0.05% or less (excluding 0%)

Niobium (Nb) is dissolved in austenite to increase the hardenability of austenite, and forms carbonitride such as Nb(C,N) to increase the strength of steel and to inhibit the growth of austenite grains.

However, if the content of Nb exceeds 0.05%, coarse precipitates may be formed, and the coarse precipitates may become a starting point of brittle fracture to deteriorate toughness.

Therefore, in the present disclosure, when Nb is added, Nb is preferably added in an amount of 0.05% or less.

Vanadium (V): 0.02% or Less (Excluding 0%)

Vanadium (V) is an element which is advantageous in suppressing the growth of austenite grains, by forming VC carbides upon reheating after hot rolling, and improving hardenability of steel to secure strength and toughness.

However, if the content of V, a relatively expensive element, exceeds 0.02%, manufacturing costs may be increased.

Therefore, in the present disclosure, when V is added, the content of V is preferably controlled to 0.02% or less.

Calcium (Ca): 2 ppm to 100 ppm

Calcium (Ca) may suppress the formation of MnS segregated at a center region in a thickness direction of a steel material by generating CaS because of a strong binding force with S. In addition, the CaS, generated by addition of Ca, may increase the corrosion resistance under a high humidity environment.

For the above-described effects, Ca is preferably added in an amount of 2 ppm or more. However, if the content of Ca exceeds 100 ppm, it is not preferable because of a problem of causing clogging of a nozzle during a steelmaking operation.

Therefore, in the present disclosure, when Ca is added, the content of Ca is preferably controlled to 2 ppm to 100 ppm.

Further, the wear-resistant steel according to the present disclosure may further include one or more among 0.05% or less of arsenic (As) (excluding 0%), 0.05% or less of tin (Sn) (excluding 0%), and 0.05% or less of tungsten (W) (excluding 0%).

The As is effective for improving the toughness of steel, while the Sn is effective for improving the strength and corrosion resistance of the steel. In addition, the W is an element effective for increasing strength and improving hardness at high temperature, by increasing hardenability.

However, if the content of each of the As, Sn, and W exceeds 0.05%, not only the manufacturing costs may be increased but also the material properties of the steel may be deteriorated. Therefore, in the present disclosure, when the wear-resistant steel further includes one or more among As, Sn, and W, it is preferable to control the content thereof to 0.05% or less.

The remaining elements of the present disclosure are iron (Fe). Merely, in a common manufacturing process, unintended impurities may be inevitably mixed from surroundings, and thus, this may not be excluded. Since these impurities are known to a person having skill in the common manufacturing process, all contents will not be particularly described in the present specification.

It is preferable that the wear-resistant steel according to the present disclosure satisfies the following Relation 1.

$$360 \leq (869 \times [C]) + 295 \leq 440 \quad \text{[Relation 1]}$$

Here, [C] means weight %.

If a value of the Relation 1 is less than 360, it may be difficult to secure surface hardness of the wear-resistant steel, provided in the present disclosure, to a grade of HB400 (preferably, 360 HB to 440 HB). On the other hand, if the value of the Relation 1 exceeds 440, it is not preferable because mismatch between welding materials and other members used together in a final product may occur.

The wear-resistant steel according to the present disclosure, satisfying the alloy composition described above and Relation 1, preferably includes a martensite phase, a microstructure, as a matrix structure.

In more detail, the wear-resistant steel according to the present disclosure includes a martensite phase in an area fraction of 97% or more (including 100%), and may include a bainite phase as other structures. The bainite phase is preferably included in an area fraction of 3% or less, or may be formed in an area fraction of 0%.

If the fraction of the martensite phase is less than 97%, it is difficult to secure strength and hardness at a target level.

Hereinafter, a method for manufacturing high-hardness wear-resistant steel, another aspect of the present disclosure, will be described in detail.

Briefly, it is preferable to prepare a steel slab satisfying the alloy composition described above, and then to manufacture high-hardness wear-resistant steel through a process of [reheating-rough rolling-finish rolling-air cooling-reheating heat treatment-quenching] with the steel slab. Hereinafter, each process condition will be described in detail.

First, a steel slab, satisfying an alloy composition and Relation 1 proposed in the present disclosure, is prepared, and then it is preferable to heat the steel slab to a temperature in a range of 1050° C. to 1250° C.

If a temperature during the heating is less than 1050° C., re-solid solution of Nb, or the like, is not sufficient. On the other hand, if the temperature during the heating exceeds 1250° C., austenite grains are coarsened, and thus an ununiform structure may be formed.

Therefore, in the present disclosure, when a steel slab is heated, heating is preferably performed to a temperature in a range of 1050° C. to 1250° C.

The heated steel slab is preferably rough rolled and finish rolled to manufacture a hot-rolled steel plate.

First of all, the heated steel slab is rough rolled to a temperature in a range of 950° C. to 1050° C. to manufacture a bar, and then the bar is preferably finish hot rolled to a temperature in a range of 750° C. to 950° C.

If a temperature during rough rolling is less than 950° C., rolling load is increased and relatively weakly pressed. In this case, the deformation is not sufficiently applied to the center of the slab thickness direction, so that defects such as pores may not be removed. On the other hand, if the temperature during rough rolling exceeds 1050° C., grains grow after the recrystallization occurs at the same time as rolling, and thus the initial austenite grains become significantly coarse.

If the finishing temperature range is less than 750° C., two-phase region rolling is performed, and thus ferrite of a microstructure may be generated. On the other hand, if the temperature exceeds 950° C., the rolling roll load is increased, and thus the rolling properties may be inferior.

The hot-rolled steel plate, manufactured as described above, is air-cooled to room temperature, and then reheating heat treatment is preferably performed in a furnace time of 20 minutes or more to a temperature in a range of 850° C. to 950° C.

The reheating heat treatment is provided to reversely transform a hot-rolled steel plate, formed of ferrite and pearlite, into an austenite single phase. Here, if a temperature during the reheating heat treating is less than 850° C., austenitization is not sufficiently performed, and coarse soft ferrite is mixed therewith, so that the hardness of a final product may be lowered. On the other hand, if the temperature exceeds 950° C., austenite grains are coarsened and thus the hardenability may be increased, but low-temperature toughness of the steel may be lowered.

If a furnace time is less than 20 minutes during reheating in the temperature range described above, austenitization may not sufficiently occur, so that the phase transformation due to the subsequent rapid cooling, that is, a martensitic structure, may not be sufficiently obtained. On the other hand, if a furnace time exceeds 60 minutes, austenite grains become coarse, and the low-temperature toughness of steel may become low.

After the reheating heat treating is completed, it is preferable to perform quenching to 100° C. or less at a cooling rate satisfying the following Relation 2.

$$CR \geq 0.2/[C] \quad \text{[Relation 2]}$$

Here, CR is a cooling rate (° C./s) during quenching after the reheating heat treating, and [C] means weight %.

If the cooling rate during quenching is less than a value of Relation 2 or a cooling stop temperature exceeds 100° C., a ferrite phase may be formed or excessive amounts of bainite phases may be formed during quenching.

The quenching may be performed advantageously at a cooling rate of 1.25° C./s or more, more advantageously, 2.5° C./s or more, and still more advantageously, 5.0° C./s or more. Here, an upper limit of the cooling rate is not particularly limited, and may be selected appropriately in consideration of facility specifications.

The hot-rolled steel plate of the present disclosure, manufactured according to the manufacturing conditions described above, includes a martensite phase, a microstructure, as a main phase, and may have high hardness, such as 360 HB to 440 HB of a Brinell hardness value.

Hereinafter, the present disclosure will be detailed through embodiments. However, these embodiments are provided so that this invention will be more completely understood, and are not intended to limit the scope of the invention. The scope of the invention is determined based on the matters claimed in the appended claims and modifications rationally derived therefrom.

MODE FOR INVENTION

Example

The steel slabs having the alloy composition illustrated in Tables 1 and 2 were prepared, and then the respective steel slabs were heated to a temperature in a range of 1050° C. to 1250° C., and then rough rolling was performed to a temperature in a range of 950° C. to 1050° C. to manufacture bars. Then, the respective bars were finish rolled in a temperature, illustrated in Table 3, to manufacture a hot-rolled steel plate, and then cooling (air cooling) was performed to room temperature. Then, the hot-rolled steel plate was reheating treated, and then quenching was performed to 100° C. or less. In this case, the reheating heat treating and quenching conditions are illustrated in Table 3.

Then, microstructures and mechanical properties with respect to respective hot-rolled steel plates were measured, and the results are illustrated in Table 4.

In the microstructure, specimens were cut to an arbitrary size to manufacture a polished surface, and the polished surface was etched using a nital solution, and then a position of 2 mm in a thickness direction from a surface layer was observed using an optical microscope and an electron scanning microscope.

Moreover, the tensile strength, hardness, and toughness were measured using a universal tensile tester, a Brinell hardness tester (a load of 3000 kgf, a tungsten indenter having a diameter of 10 mm), and a Charpy impact tester, respectively. In this case, in a tensile test, a total thickness of a plate was used as a specimen, and Brinell hardness is provided as an average value obtained by measuring a position of 2 mm in a thickness direction from a surface three times after a milling processing is performed thereon. Moreover, the result of the Charpy impact test is provided as an average value obtained by measuring three times at −40° C.

TABLE 1

| | Alloy Composition (wt. %) | | | | | | | | | | | |
|---|---|---|---|---|---|---|---|---|---|---|---|---|
| Steel | C | Si | Mn | P | S | Al | Cr | Ni | Mo | B (ppm) | Co | Relation 1 |
| A | 0.065 | 0.32 | 1.95 | 0.0092 | 0.0021 | 0.031 | 0.51 | 0.85 | 0.42 | 0 | 0 | 351 |
| B | 0.170 | 0.45 | 1.22 | 0.0100 | 0.0004 | 0.012 | 0.29 | 0.06 | 0.14 | 14 | 0.01 | 443 |
| C | 0.224 | 0.34 | 1.55 | 0.0059 | 0.0005 | 0.031 | 0.01 | 1.12 | 0.01 | 0 | 0 | 490 |

TABLE 1-continued

| Steel | Alloy Composition (wt. %) C | Si | Mn | P | S | Al | Cr | Ni | Mo | B (ppm) | Co | Relation 1 |
|---|---|---|---|---|---|---|---|---|---|---|---|---|
| D | 0.086 | 0.31 | 1.37 | 0.0066 | 0.0018 | 0.025 | 0.79 | 0.014 | 0.04 | 20 | 0.02 | 370 |
| E | 0.153 | 0.30 | 1.20 | 0.0076 | 0.0006 | 0.019 | 0.41 | 0.012 | 0.03 | 18 | 0.01 | 428 |
| F | 0.121 | 0.24 | 0.89 | 0.0083 | 0.0009 | 0.024 | 0.15 | 0.075 | 0.05 | 21 | 0.01 | 400 |
| G | 0.104 | 0.29 | 1.23 | 0.0054 | 0.0013 | 0.038 | 0.24 | 0.011 | 0.03 | 23 | 0.03 | 385 |

TABLE 2

| Steel | Alloy Composition (wt. %) Cu | Ti | Nb | V | Ca (ppm) |
|---|---|---|---|---|---|
| A | 0.24 | 0.021 | 0.041 | 0.050 | 10 |
| B | 0.01 | 0.019 | 0.015 | 0.001 | 8 |
| C | 0.47 | 0.016 | 0.024 | 0.002 | 7 |
| D | 0.03 | 0.017 | 0.016 | 0.002 | 12 |

TABLE 2-continued

| Steel | Alloy Composition (wt. %) Cu | Ti | Nb | V | Ca (ppm) |
|---|---|---|---|---|---|
| E | 0.02 | 0.015 | 0.005 | 0.004 | 8 |
| F | 0.04 | 0.014 | 0.014 | 0.018 | 7 |
| G | 0.02 | 0.016 | 0.011 | 0.003 | 15 |

TABLE 3

| Steel | Manufacturing Conditions: Finish Rolling Temperature (° C.) | Reheating Heat Treatment: Temperature (° C.) | Reheating Heat Treatment: Duration time (min) | Quenching: Cooling Rate (° C./s) | Quenching: Stop Temperature (° C.) | Whether of Satisfaction Relation of 2 | Thickness (mm) | Classification |
|---|---|---|---|---|---|---|---|---|
| A | 900 | 905 | 42 | 36.2 | 51 | ○ | 12 | Comparative Example 1 |
| | 900 | 919 | 36 | 54.1 | 148 | ○ | | Comparative Example 2 |
| | 912 | 888 | 38 | 50.2 | 43 | ○ | | Comparative Example 3 |
| B | 867 | 933 | 35 | 21.0 | 124 | ○ | 10 | Comparative Example 4 |
| | 878 | 914 | 24 | 67.1 | 38 | ○ | | Comparative Example 5 |
| | 876 | 876 | 40 | 50.2 | 64 | ○ | | Comparative Example 6 |
| C | 912 | 860 | 56 | 35.1 | 207 | ○ | 20 | Comparative Example 7 |
| | 1010 | 921 | 63 | 41.2 | 165 | ○ | | Comparative Example 8 |
| | 1015 | 915 | 60 | 38.3 | 58 | ○ | | Comparative Example 9 |
| D | 927 | 913 | 46 | 54.0 | 251 | ○ | 12 | Comparative Example 10 |
| | 915 | 920 | 48 | 48.6 | 28 | ○ | | Inventive Example 1 |
| | 924 | 911 | 50 | 58.7 | 32 | ○ | | Inventive Example 2 |
| E | 950 | 905 | 18 | 31.5 | 25 | ○ | 30 | Comparative Example 11 |
| | 946 | 911 | 69 | 28.7 | 40 | ○ | | Inventive Example 3 |
| | 937 | 897 | 65 | 26.0 | 32 | ○ | | Inventive Example 4 |
| F | 933 | 912 | 56 | 43.2 | 57 | ○ | 20 | Inventive Example 5 |
| | 935 | 934 | 66 | 45.6 | 42 | ○ | | Inventive Example 6 |
| | 940 | 838 | 54 | 51.3 | 32 | ○ | | Comparative Example 12 |
| G | 900 | 922 | 40 | 63.9 | 54 | ○ | 8 | Inventive Example 7 |
| | 898 | 904 | 38 | 75.2 | 81 | ○ | | Inventive Example 8 |
| | 912 | 917 | 41 | 68.7 | 61 | ○ | | Inventive Example 9 |

TABLE 4

| Classification | Microstructure (Area fraction %) Martensite | Bainite | Mechanical Properties Tensile Strength (MPa) | Hardness (HB) | Toughness (J) |
|---|---|---|---|---|---|
| Comparative Example 1 | 99 | 1 | 1088 | 351 | 58 |
| Comparative Example 2 | 90 | 10 | 973 | 314 | 72 |
| Comparative Example 3 | 99 | 1 | 1103 | 356 | 45 |
| Comparative Example 4 | 95 | 5 | 1333 | 443 | 32 |
| Comparative Example 5 | 100 | 0 | 1404 | 465 | 28 |
| Comparative Example 6 | 100 | 0 | 1394 | 460 | 77 |
| Comparative Example 7 | 87 | 13 | 1377 | 453 | 85 |
| Comparative Example 8 | 92 | 8 | 1440 | 472 | 44 |
| Comparative Example 9 | 100 | 0 | 1499 | 490 | 12 |
| Comparative Example 10 | 84 | 16 | 1059 | 345 | 68 |
| Inventive Example 1 | 100 | 0 | 1146 | 372 | 45 |
| Inventive Example 2 | 100 | 0 | 1159 | 375 | 38 |
| Comparative Example 11 | 73 | 27 | 942 | 304 | 108 |
| Inventive Example 3 | 99 | 1 | 1288 | 428 | 31 |
| Inventive Example 4 | 98 | 2 | 1271 | 421 | 36 |
| Inventive Example 5 | 100 | 0 | 1215 | 401 | 40 |
| Inventive Example 6 | 100 | 0 | 1234 | 406 | 37 |
| Comparative Example 12 | 96 | 4 | 1086 | 356 | 68 |
| Inventive Example 7 | 100 | 0 | 1178 | 385 | 39 |
| Inventive Example 8 | 100 | 0 | 1200 | 391 | 40 |
| Inventive Example 9 | 100 | 0 | 1195 | 388 | 35 |

As illustrated in Tables 1 to 4, in the case of Comparative Examples 1 to 9, not satisfying one or more conditions among a steel alloy composition, Relation 1, and manufacturing conditions, it is confirmed that a hardness (HB) value of a hot-rolled steel plate is not satisfied with a level of the present disclosure.

In detail, in the case of Comparative Examples 1 to 3 using Comparative Steel 1 in which the content of C is insufficient, a hardness value is low. On the other hand, in the case of Comparative Examples 4 to 9 using Comparative Steel 2 or 3 in which the content of C is excessive, it is confirmed that a hardness value is significantly high.

In the case of Comparative Example 10, with which the steel alloy composition and the Relation 1 are satisfied, and in which a cooling stop temperature is high during quenching after reheating heat treatment, a martensite phase is not sufficiently formed, and thus a hardness value is inferior. Moreover, in the case of Comparative Example 11, in which an in a furnace time during reheating heat treatment is insufficient, and Comparative Example 12, in which a reheating temperature is low, a martensite phase is not sufficiently formed, and thus a hardness value is significantly inferior.

On the other hand, in the case of Inventive Examples 1 to 9, satisfying all of the steel alloy composition, Relation 1, and manufacturing conditions, a martensite phase is formed to 97% or more, high strength and high toughness (30 J or more at −40° C.) are obtained, and a hardness value is obtained to a target level.

FIG. 1 illustrates an observation result of a microstructure of a center region of Inventive Example 8, and formation of a martensite phase could be confirmed with the naked eye.

The invention claimed is:

1. A wear-resistant steel, comprising:

0.08 wt. % to 0.16 wt. % of carbon (C), 0.1 wt. % to 0.7 wt. % of silicon (Si), 0.8 wt. % to 1.6 wt. % of manganese (Mn), 0.05 wt. % or less of phosphorous (P), excluding 0 wt. %, 0.02 wt. % or less of sulfur (S), excluding 0 wt. %, 0.07 wt. % or less of aluminum (Al), excluding 0 wt. %, 0.1 wt. % to 1.0 wt. % of chromium (Cr), 0.01 wt. % to 0.075 wt. % of nickel (Ni), 0.01 wt. % to 0.2 wt. % of molybdenum (Mo), 50 ppm or less of boron (B), excluding 0 ppm, and 0.04 wt. % or less of cobalt (Co), excluding 0 wt. %, further comprising: one or more among 0.1 wt. % or less of copper (Cu), excluding 0 wt. %, 0.02 wt. % or less of titanium (Ti), excluding 0 wt. %, 0.05 wt. % or less of niobium (Nb), excluding 0 wt. %, 0.02 wt. % or less of vanadium (V), excluding 0 wt. %, and 2 ppm to 100 ppm of calcium (Ca), comprising: the balance of iron (Fe) and other inevitable impurities, and satisfying [Relation 1], wherein a microstructure includes martensite in an area fraction of 97% or more and bainite in an area fraction of 3% or less, and wherein the wear-resistant steel has a thickness of 40 mm or less, and Brinell hardness of 360 HB to 440 HB, $$360 \leq (869 \times [C]) + 295 \leq 440, \quad \text{[Relation 1]:}$$

wherein [C] means weight % of carbon (C).

2. The wear-resistant steel of claim 1, wherein the wear-resistant steel further comprises: one or more among 0.05 wt. % or less of arsenic (As), excluding 0 wt. %, 0.05 wt. % or less of tin (Sn), excluding 0 wt. %, and 0.05 wt. % or less of tungsten (W), excluding 0 wt. %.

3. A method for manufacturing the wear-resistant steel of claim 1, comprising:

preparing a steel slab including 0.08 wt. % to 0.16 wt. % of carbon (C), 0.1 wt. % to 0.7 wt. % of silicon (Si), 0.8 wt. % to 1.6 wt. % of manganese (Mn), 0.05 wt. % or less of phosphorous (P), excluding 0 wt. %, 0.02 wt. % or less of sulfur (S), excluding 0 wt. %, 0.07 wt. % or less of aluminum (Al), excluding 0 wt. %, 0.1 wt. % to 1.0 wt. % of chromium (Cr), 0.01 wt. % to 0.075 wt. % of nickel (Ni), 0.01 wt. % to 0.2 wt. % of molybdenum (Mo), 50 ppm or less of boron (B), excluding 0 ppm, and 0.04 wt. % or less of cobalt (Co), excluding 0 wt. %, further comprising one or more among 0.1 wt. % or less of copper (Cu), excluding 0 wt. %, 0.02 wt. % or less of titanium (Ti), excluding 0 wt. %, 0.05 wt. % or less of niobium (Nb), excluding 0 wt. %, 0.02 wt. % or less of vanadium (V), excluding 0 wt. %, and 2 ppm to 100 ppm of calcium (Ca), comprising the balance of iron (Fe) and other inevitable impurities, and satisfying [Relation 1];

heating the steel slab to a temperature in a range of 1050° C. to 1250° C.;

rough rolling the reheated steel slab to a temperature in a range of 950° C. to 1050° C.;

manufacturing a hot-rolled steel plate by finish rolling at a temperature in a range of 750° C. to 950° C. after the rough rolling;

reheating heat treating in a furnace time of 20 minutes or more to a temperature in a range of 850° C. to 950° C., after the hot-rolled steel plate is air-cooled to room temperature; and quenching the hot-rolled steel plate to 100° C. or less at a cooling rate satisfying [Relation 2], after the reheating heat treating, $$360 \leq (869 \times [C]) + 295 \leq 440 \quad \text{[Relation 1]:}$$

$$CR \geq 0.2/[C] \quad \text{[Relation 2]:}$$

wherein [C] in [Relation 1] and [Relation 2] means weight % of carbon (C), and CR in [Relation 2] is a cooling rate, in ° C./s, during quenching after reheating heat treating.

4. The method for manufacturing wear-resistant steel of claim 3, wherein, after the reheating heat treating, the quenching is performed at a cooling rate of 1.5° C./s or more.

5. The method for manufacturing wear-resistant steel of claim 3, wherein the steel slab further includes one or more among 0.05 wt. % or less of arsenic (As), excluding 0 wt. %, 0.05 wt. % or less of tin (Sn), excluding 0 wt. %, and 0.05 wt. % or less of tungsten (W), excluding 0 wt. %.

* * * * *